114-253 SR
1/27/81 XR 4,246,860

United States Patent [19]
Saund, deceased et al.

[11] 4,246,860
[45] Jan. 27, 1981

[54] METHOD FOR ANCHOR RETRIEVAL

[75] Inventors: Dalip Saund, deceased, late of Laguna Beach, Calif.; by Dorothy Saund, sole heir, 12966 Rubens Ave., Los Angeles, Calif. 90066

[73] Assignee: Dorothy A. Saund, Los Angeles, Calif.

[21] Appl. No.: 967,214

[22] Filed: Dec. 7, 1978

[51] Int. Cl.[3] ..... B63B 21/22
[52] U.S. Cl. ..... 114/293; 114/244; 114/253
[58] Field of Search ..... 114/294, 293, 297, 299, 114/210, 244, 245, 253, 221 R, 230, 51; 294/66 R; 212/3

[56] References Cited

U.S. PATENT DOCUMENTS

| | | | |
|---|---|---|---|
| 1,582,130 | 4/1926 | Currey | 114/51 |
| 2,373,414 | 4/1945 | Plummer | 294/66 R X |
| 3,559,817 | 2/1971 | Brown | 212/3 X |
| 4,051,800 | 10/1977 | Farstad | 114/297 |

FOREIGN PATENT DOCUMENTS

| | | | |
|---|---|---|---|
| 2308544 | 11/1976 | France | 114/293 |

*Primary Examiner*—Sherman D. Basinger
*Attorney, Agent, or Firm*—Daniel C. McKown

[57] ABSTRACT

The method is applicable for retrieving an anchor having an anchor buoy holding an anchor pendant line. A trailer buoy is connected to the anchor pendant line via a floatable line. A work vessel is fitted with a boom having a catch hook so positioned that the hook is several feet abeam of the vessel and at or below the waterline. Capture is achieved by sailing the vessel so as to cause the trailer buoy to pass between the vessel and the boom hook so that the boom hook snags the floatable line. The boom is swung out of the water and sternward so that the trailer buoy and a section of the floatable line are brought aboard the vessel, the floatable line then being used to retrieve the anchor pendant line. The floatable line may be in two sections to facilitate attachment to winches, cranes or other retrieval equipment.

3 Claims, 9 Drawing Figures

8
9
10
22
18
21
23
11
16
15
12
17
19

18
22
21
19

METHOD FOR ANCHOR RETRIEVAL

BACKGROUND OF THE INVENTION

1. Field of the Invention

This invention relates to a method for capturing and retrieving objects on the high seas. The described invention is particularly useful in the retrieval of anchors used in positioning offshore construction and drilling vessels.

2. The Prior Art

In the art practiced today the requirements for very accurate and steady positioning and for precision movements of construction and drilling vessels are commonly achieved by tethering the vessel within an array of anchors with each anchor line attached to its own independently operable winch onboard the vessel. By coordinated operation of the winches, the vessel can be held in any fixed position or moved in any desired direction within the area defined by the outlying anchors and with great precision. Before the vessel can move to a position outside the area defined by the anchor array, the anchors must be moved so that the new array encompasses the desired new location. It is common for a vessel to have an eight to twelve anchor array and for pipe laying barges it is common for each anchor to be moved several times a day. Because anchors are almost always placed at considerable distances from the vessel, anchors are retrieved for storage or relocation by supporting vessels (tugs).

Each anchor has attached to it a pendant line heavy enough to raise the anchor, the free end of which is floated on the surface by an anchor buoy which must be large enough to support the great weight of the pendant line. Actually, the pendant line is usually free to slide through a hole in the buoy and is prevented from falling by a loop formed on the free end of the pendant line. To retrieve an anchor, the support tug must locate and draw alongside the anchor buoy, attach a winch line to the pendant line loop and raise the anchor by winching in the winch line and the pendant line. The pendant line is drawn through the anchor buoy during this operation pinning the buoy against the tug. The anchor is raised only to the bottom of the anchor buoy and, thus, remains underwater. The anchor, though now raised, is still attached to the construction vessel via the anchor line. By coordinated action of the tug and the anchor line winch onboard the construction vessel, the anchor can be relocated anywhere within a radius limited only by the total length of the anchor line, or the anchor may be brought back to the construction vessel for storage. Typical component sizes are 4,000 to 5,000 feet of anchor line of 2 $\frac{5}{8}$" diameter wire rope weighing nearly one ton per 100 feet, 100 feet to more than 1,000 feet of anchor pendant line of 2" to 2 $\frac{5}{8}$" wire rope weighing from $\frac{1}{2}$ ton to nearly one ton per 100 feet, 15 to 30 ton anchors, 8 to 10 ton anchor buoys measuring 8 feet in diameter by 15 feet long. Components of these magnitudes are very difficult to handle.

The most difficult part of the operation is attaching the winch line to the pendant line loop, which must now be performed manually. While the tug captain attempts to keep his tug in a relatively fixed position along side the anchor buoy, workmen standing on the tug must reach over the side a minimum of four feet to manually attach the heavy winch line to the anchor pendant line loop. The working position is awkward and dangerous even in calm seas when the rolling and pitching of a tug can make a workman's footing extremely precarious. In only moderate (Beaufort force 4) seas, differences between the tug and the anchor buoy in mass, shape and exact position on the waves causes relative asynchronous motion between the two with the result that they often collide with great force. The higher the seas the more difficult and dangerous the operation. It is widely recognized that anchor retrieval cannot be carried out in greater than force 5 seas and that this is because it is too difficult and dangerous under such conditions to attach a winch line to the anchor pendant line. Until recently this limitation was not a significant factor because construction vessels could not work in seas higher than about force 5. However, with the recent development of more stable construction vessels, the problems of anchor retrieval have become a limiting factor and a number of attempts have been made to solve the problem.

One method uses a remote-releasable hook suspended on a service line from a support vessel as disclosed in U.S. Pat. No. 3,927,636 issued Dec. 23, 1975 to Childers, et al. The support vessel sails so as to cause the hook to snag the anchor line underwater and near the construction vessel and then causes the hook to slide down the anchor line to the anchor by sailing toward and past the anchor. The anchor is then raised by raising the hook. U.S. Pat. No. 3,929,087 issued Dec. 30, 1975 to Montgomery appears to be essentially the same but without the catch device or the remote-release feature. It is known that in practice the snagging operation is difficult. The deployment of anchors using a special remote-release hook is described along with another configuration of the remote-release catch hook in U.S. Pat. No. 3,931,782 issued Jan. 13, 1976 to Childers, et al. It is also known that at least one company operating in the North Sea attempted anchor retrieval by placing a large ring around the anchor line. A tug with a line attached was used to retrieve the anchor. The method was abandoned as impractical because of the difficulty of keeping enough tension on the ring line to prevent the anchor from sliding back to the bottom of the sea.

A retractable basket is disclosed in U.S. Pat. No. 3,993,011 issued Nov. 23, 1976 to Garland for recovering a special anchor buoy, which requires that the support vessel be fitted with the large and complex special handling system.

Another attempted solution required the use of a catamaran tug which passed over the anchor buoy so that the buoy was caught in a cradle suspended between the two hulls of the tug. The system was found to be impractical in high seas due to the damage caused by violent impact between the tug and the anchor buoy.

Another proposed solution would have the heavy anchor pendant line remain on the sea bottom and utilize a small, light buoy and line to mark and raise the anchor pendant line for retrieval, as disclosed in U.S. Pat. No. 4,051,800, issued Oct. 4, 1977 to Farstad.

The use of a large electromagnet to capture the anchor buoy long enough to secure a winch line to the anchor pendant line loop has also been proposed. A full scale electromagnet has been built and tested on land but has not been subjected to sea trials.

SUMMARY OF THE INVENTION

In the practice of this invention the method is to deploy a small, light trailer buoy tied to the pendant line loop which, with appropriate apparatus, can be retrieved without requiring the support tug to stand dead in the water along side the massive, uncontrolled anchor buoy. In the preferred embodiment, a heavy floatable haul line is attached to the pendant line loop. The free end of the haul line is formed into a loop and is joined, via a shackle or other quick disconnect means, to a lighter floatable catch line. The combined haul line and catch line is sometimes referred to as the trailer line. The free end of the catch line has an enlarged stop which, in turn, is connected to the trailer buoy. The trailer buoy, though small and light, is of sufficient size to house spotting aids such as a light and/or radar transponder. The trailer buoy is also shaped so as to present a sail surface to the wind to insure that the trailer buoy will be downwind from the anchor buoy at all times.

The retrieval tug is fitted with a retractable boom having a catch slot such that, in the extended position, the slot is held at the water line and several feet abeam of the tug. By maneuvering the tug obliquely into the wind so as to cause the trailer buoy to pass between the tug and the catch slot, the slot snags the catch line. The tug continues moving into the wind with only slight changes in course until it passes and is directly upwind from the anchor buoy with the catch line taut and to the stern so that the haul line loop is over the work deck of the tug. During this latter maneuver the boom is retracted by raising the free end and swinging the boom approximately 90° in the direction of the stern.

Once the haul line loop is over the work deck, the crew can safely attach a winch line to the haul line loop, haul in the winch line to slacken the catch line, disconnect the catch line, and raise the anchor. At no time is it necessary for a workman to work over the side, nor is it necessary at any time for the tug to maneuver alongside an uncontrolled anchor buoy.

DETAILED DESCRIPTION OF THE INVENTION

Figure 1:
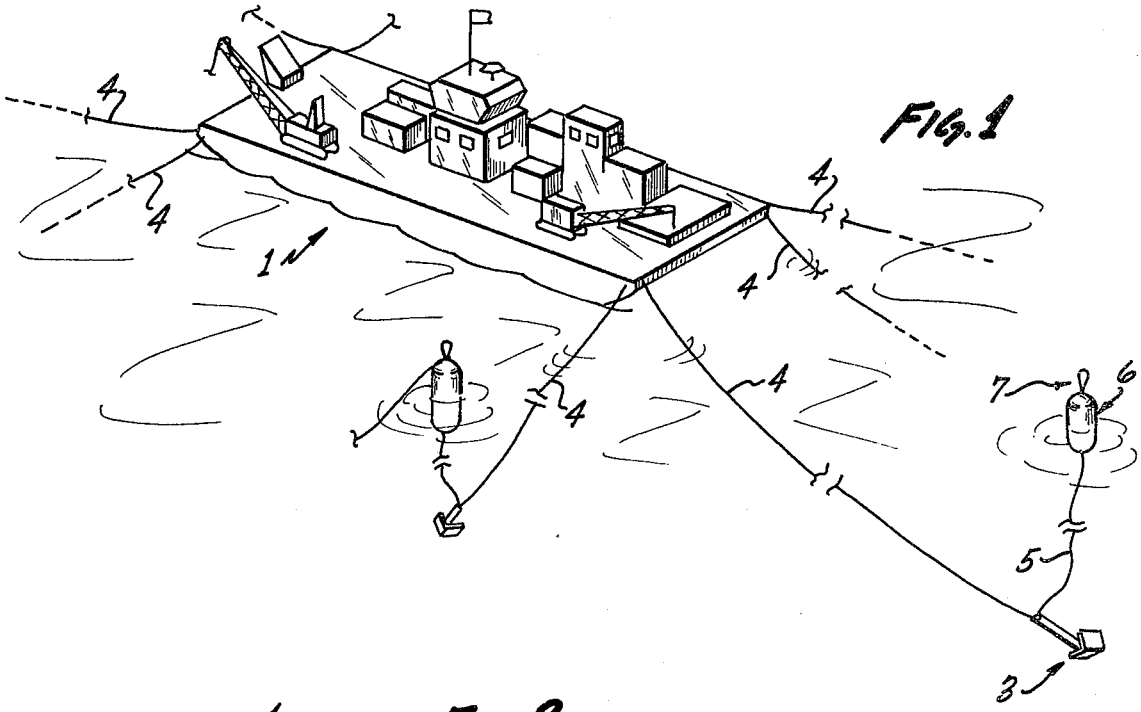
FIG. 1 is a perspective view showing a pipe laying barge positioned with eight anchors.
Figure 2:
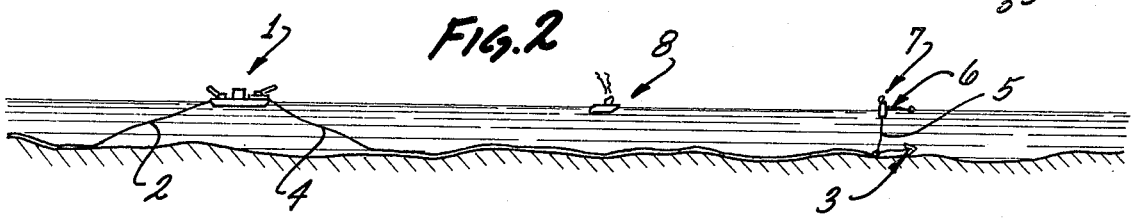
FIG. 2 is a scale profile view of the pipe laying barge and related apparatus showing relative sizes and distances typically encountered.

Referring now to the drawings, in which like parts are denoted by the same reference numerals, there is shown in FIGS. 1 and 2 a construction vessel 1 working at sea, here depicted as a pipe laying barge constructing an undersea pipeline 2. The barge is positioned within an array of anchors 3 with each anchor connected to its own anchor winch (not shown) on the barge by an anchor line 4 which is typically 4,000 feet or more long when fully deployed. Each anchor 3 has attached to it a second, independent anchor pendant line 5 which is longer than the depth of the sea and strong enough to break the anchor loose from the sea floor and raise it. The pendant line 5 passes through an anchor buoy 6, the latter being large enough to provide the buoyancy necessary to hold the free end of the pendant line on the surface and rugged enough to withstand the various stresses to which it is subjected. The free end of the pendant line is formed into the shape of a loop 7 which performs the dual function of preventing the pendant line 5 from falling clear of the anchor buoy 6 and of providing a practical means of attaching another line to the pendant line 5. A support tug 8, which is used to raise the anchor, is fitted with a winch 9 to which is attached a winch line 10. Both the winch and the winch line must be strong enough to raise the anchor pendant line 5, the anchor 3, and the anchor line 4, taking into account the added stresses due to tug movement on the waves and due to the friction of the pendant line passing through the anchor buoy. All of these elements are part of the present art.

Figure 3:
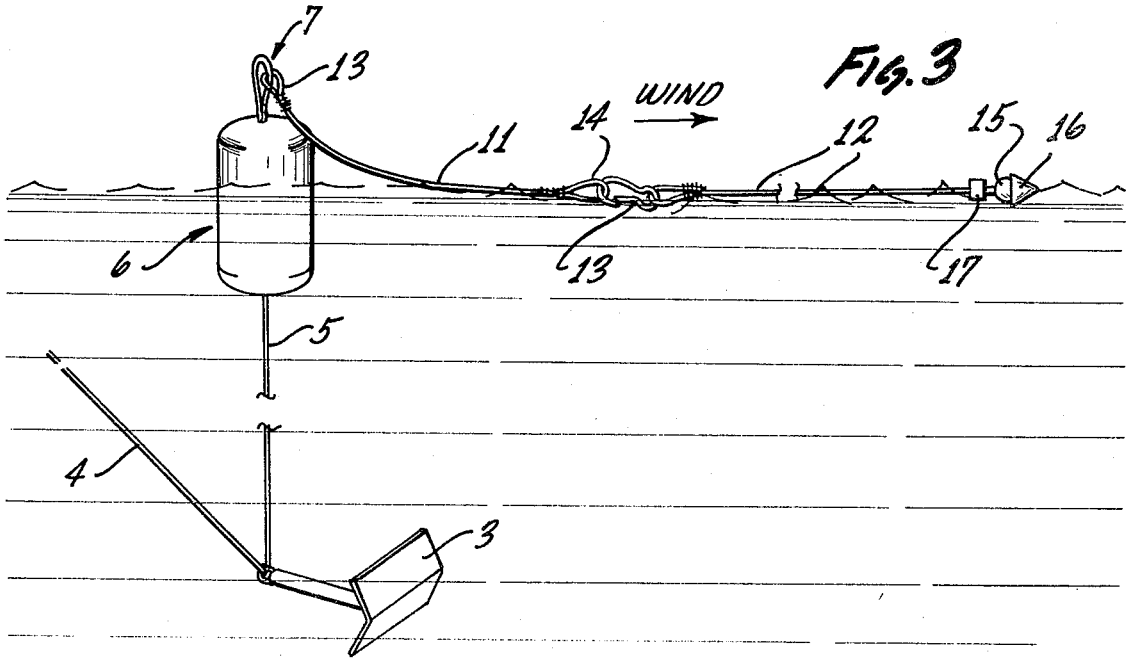
FIG. 3 is a diagram illustrating the connection of the haul and catch lines with the trailer buoy holding them downwind from the anchor buoy.

The apparatus aspect of this invention shown in FIG. 3 adds a two part trailer line consisting of a haul line 11 and a catch line 12 both made of a floating rope material such as polypropylene. The haul line 11 is attached to the pendant line loop 7 with a shackle 13 or other quick disconnect device. The free end of the haul line 11 is formed into a loop 14 to which is attached the catch line 12 by another shackle 13. The catch line must be strong enough to withstand the stresses of holding the trailer line taut between the tug 8 and the anchor buoy 6 and any added stresses of relative movement.

The free end of the catch line is detachably connected to a small trailer buoy 15. In the preferred embodiment, the trailer buoy is shaped so as to present a sail surface 16 to the wind so that at sea it will tend to move downwind away from the anchor buoy 6. Thus, the trailer buoy and trailer line will always be drawn out in a straight line and their direction will always be known. Furthermore, since, especially in high seas, a vessel is more stable and under better control while sailing into the wind, capture of the trailer buoy can always be accomplished under nearly optimum conditions. In the preferred embodiment, the trailer buoy 15 is large enough to house a marker light and a radar transponder which, by the present art, could be contained and floated in a spherical buoy approximately 2 feet in diameter. The end of the catch line is fitted with a stop 17 next to the trailer buoy attachment point. Thus, tensile stresses transmitted from the catch slot to the catch line will not be carried by the trailer buoy. Therefore, the trailer buoy can be made of plastic or other inexpensive materials.

Figure 4:
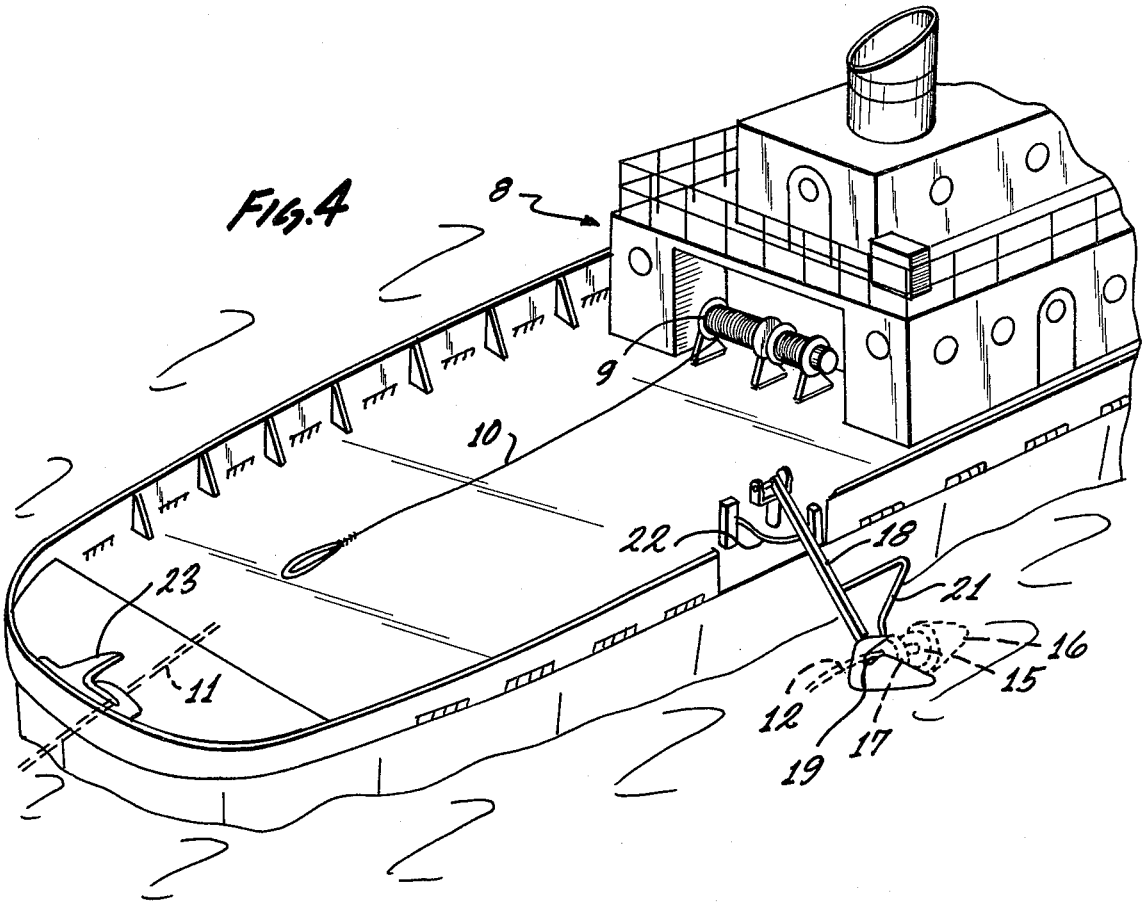
FIG. 4 is a perspective view depicting the boom in the extended position ready for retrieval of the trailer buoy.
Figure 5:
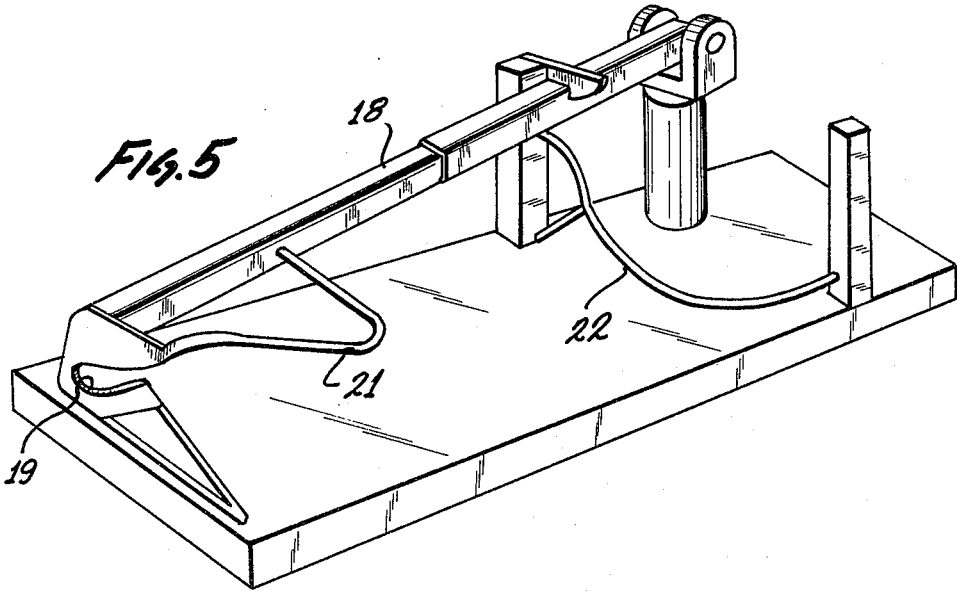
FIG. 5 is a perspective view showing a boom used in the preferred embodiment for snagging the trailer buoy.
Figure 6:
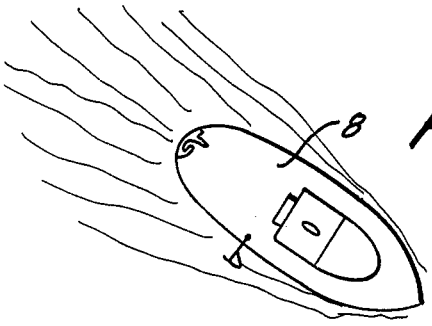
FIG. 6 is a plan view showing the tug moving, with boom extended, about to snag the trailer buoy.

As shown in FIGS. 4 and 5, tug 8 is fitted with a retractable boom 18 so positioned that it can be extended over the side of the tug such that the boom end is several feet abeam of the tug and at or near the waterline. The end of the boom is fitted with an open catch slot 19 so shaped and positioned that the opening faces the bow of the tug when the boom is extended. The catch slot opening is in the shape of a guide to direct the catch line 12 into the slot and is augmented by additional guides 21 top and bottom.

In retracting, the boom rotates approximately 90° toward the stern about a vertical axis and, simultaneously, approximately 45° about a horizontal axis. Thus, in the retracted position the boom faces the stern of the tug with boom arm horizontal so that the catch slot is over the deck work area. In the preferred embodiment, rotation about the vertical axis is powered but rotation about the horizontal axis is achieved by the boom riding on a camming surface 22. The boom is held firmly when maintained in both the extended and retracted positions, either by a locking mechanism or by the power retraction mechanism, to prevent hazardous and damaging movement about the rolling and pitching tug. In a preferred embodiment the boom 18 includes a shock absorber to lessen the shocks on the trailer line that would be expected in high seas.

In the preferred embodiment, the stern of the tug is fitted with a guide 23 that will accept the anchor pendant line loop. This guide is so shaped that the haul line, when under tension and over the stern of the tug, will tend to enter and stay in the guide. Thus, the trailer line will be held steady in high seas when the motion of the tug and/or the anchor buoy might otherwise cause the trailer line to sweep dangerously across the deck.

The method aspect of this invention, illustrated in FIGS. 6–9, requires that the tug 8 sail close by the trailer buoy 15 bearing nearly into the wind but with the side containing the boom slightly upwind. In so doing, the trailer buoy is caused to pass between the tug hull and the catch slot 19 at the end of the boom so that the catch line 12 is caught in the catch slot. Should a condition of high seas cause the tug to miss the trailer buoy, successive passes can be made quickly and easily until a successful snag is achieved.

Figure 7:
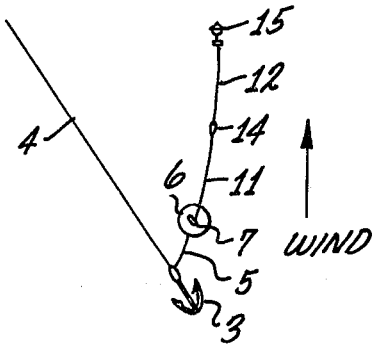
FIG. 7 is a plan view showing the tug just after snagging the trailer buoy.
Figure 8:
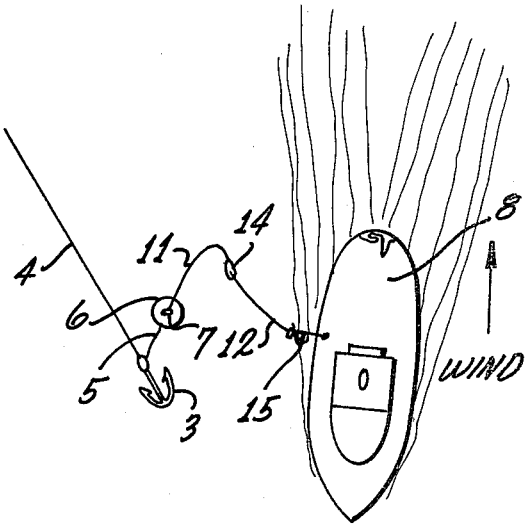
FIG. 8 is a plan view showing the tug upwind from the anchor buoy with the boom retracted, just before the winch line is attached to the haul line loop; and, FIG. 9 is a plan view showing the winch line hauled in so that the catch line is slackened for removal from the haul line loop.
Figure 8:
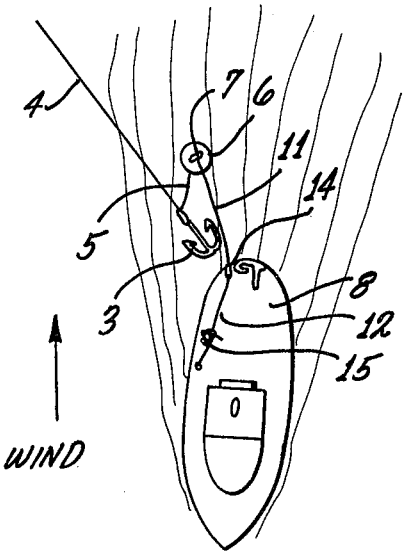

Immediately after a successful snag, the tug is turned directly into the wind so that it sails past the anchor buoy 6 to a position upwind of it, as shown in FIGS. 7 and 8. At the same time, the boom 18 is retracted so that as the tug approaches a distance from the anchor buoy equal to the length of the trailer line, the trailer line will be pulled taut over the work area at the stern of the tug. This maneuver also keeps the tug into the seas thereby providing the tug captain with the best conditions for maintaining control of his vessel. Still another result of this maneuver is to cause the trailer line to be drawn taut in the least stressful direction with respect to the anchor buoy. This is because the anchor buoy tends to lie downwind from the anchor, being held only by the tension on the pendant line, so that any tension on the trailer line will work in the opposite direction and, therefore, will not involve a stress from any other body than the anchor buoy.

Figure 9:
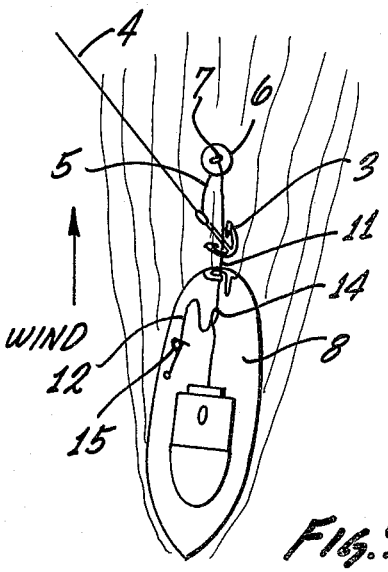

While the captain holds the tug in this position, the crew can, while working entirely within the confines of the tug, connect the winch line to the haul line loop 14, haul in the winch line 10 until the catch line 12 is slack, as shown in FIG. 9, disconnect the catch line, and haul in the winch, haul and anchor pendant lines 10, 11, 5, until the pendant line loop 7 is over the deck, disconnect the winch cable from the haul line loop 14, attach the winch cable 10 to the pendant loop 7, and then haul in the pendant line 5 to raise the anchor. The anchor buoy 6 is drawn against the tug by the horizontal force applied to the anchor buoy by the line to the winch. The tug may then move to a new location and the steps may then be reversed to lower the anchor. The geometry of these operations requires that the catch line be longer than the perpendicular distance from the retracted position of the catch slot 19 and the line between the guide 23 and the winch 9. All operations and maneuvers are identical to or very similar to those already practiced by the crew. The most critical skill required is that the captain be able to hold his tug upwind of the anchor buoy with the trailer line taut without putting so much stress on the trailer line as to break the catch line which is the weakest part of the trailer line.

Thus, there has been described a method for retrieving an object on the high seas which is both safe and effective, and which can readily be adopted for use by existing ships and equipment.

What is claimed is:

1. A method for moving anchors having an anchor line passing through an anchor buoy terminating in a pendant loop comprising the steps of:

attaching one end of a floatable haul line to the pendant loop, attaching one end of a floatable catch line to a trailer buoy and the other end to the floatable haul line, snagging the floatable catch line and the trailer buoy from a work vessel and hauling the trailer buoy onto the vessel, separating the floatable haul line from the floatable catch line and attaching a winch cable from the vessel to the floatable haul line to haul the anchor pendant loop onto the vessel, and separating the winch cable from the floatable haul line and attaching the winch cable to the anchor pendant loop for hauling the anchor.

2. A method according to claim 1 which further comprises the step of hauling up the anchor line until the anchor is clear of the bottom thereby holding the anchor buoy against the vessel.

3. A method according to claim 2 which includes the steps of:

moving the vessel to a new location, releasing the hold on the anchor line until the anchor is again resting on the bottom, attaching a floatable haul line to the pendant loop, releasing the winch cable from the pendant loop, attaching a floatable catch line connected to a trailer buoy to the floatable haul line, and lowering the floatable haul line and the floatable catch line with the trailer buoy into the water and moving the vessel clear.

* * * * *